United States Patent [19]

Weihrauch

[11] Patent Number: 5,011,230

[45] Date of Patent: Apr. 30, 1991

[54] PROCESS FOR THE PRODUCTION OF BRUSHWARE

[75] Inventor: Georg Weihrauch, Waldmichelbach, Fed. Rep. of Germany

[73] Assignee: Coronet-Werke Heinrich Schlerf GmbH, Waldmichelbach, Fed. Rep. of Germany

[21] Appl. No.: 123,887

[22] Filed: Nov. 23, 1987

Related U.S. Application Data

[63] Continuation of Ser. No. 823,648, Jan. 29, 1986, abandoned.

[30] Foreign Application Priority Data

Jan. 31, 1985 [DE] Fed. Rep. of Germany ..... 3503223

[51] Int. Cl.[5] ..... A46D 3/00

[52] U.S. Cl. ..... 300/21

[58] Field of Search ..... 15/194; 300/2, 4–11, 300/21; 264/243

[56] References Cited

FOREIGN PATENT DOCUMENTS 1094756 12/1967 United Kingdom .

*Primary Examiner*—Mark Rosenbaum

*Attorney, Agent, or Firm*—Antonelli, Terry, Stout & Kraus

[57] ABSTRACT

Brushware, such as brushes, paintbrushes, brooms or the like, comprising a bristle carrier and thermoplastic material bristle bundles fixed thereto are manufactured in that the ends of the bristle bundles are melted down and shaped to form a solid bolt-like attachment. On it is shaped a contour serving to provide a preferably detachable fixing of the bristle bundle to the bristle carrier, while on or in conjunction with the bristle carrier a corresponding contour is provided for the preferably detachable fixing of the bristle bundle. This makes it possible to fit the bristle bundles in a simple manner to the bristle carrier and to replace same by new bristle bundles in the case of wear or the like.

16 Claims, 3 Drawing Sheets

PROCESS FOR THE PRODUCTION OF BRUSHWARE

This is a continuation application of Ser. No. 823,648, filed Jan. 29, 1986, now abandoned.

BACKGROUND OF THE INVENTION

The present invention relates to a process for the production of brushware, such as brushes, paintbrushes, brooms and the like comprising a bristle carrier and thermoplastic bristle bundles fixed thereto, in that the ends of the bundle used for fixing are melted on and formed into a solid attachment.

The use of plastic bristles has of late led to the development of a new production technology, in that one end of the bristles is fixed by welding directly to a plastic bristle carrier (DE-OS 23 35 468 and DE-OS 2937 241). The bristles are either butt welded to the bristle carrier (DE-OS 29 37 241) or are melted on over a considerable length and are then sealed into holes of the bristle carrier (DE-OS 23 35 468). It is also known to melt on the bristle ends in a form or mould having several bundles and allowing the melt to solidify, so that several bundles are interconnected by a profile strip, the latter directly forming the bristle carrier (DE-OS 23 35 468).

In the brushware produced both in this way and in the conventional way, following the wearing of the bristles, the appliance becomes useless. This is particularly uneconomic in the case of expensive machine brushes, in which the bristles only represent a small proportion of the total costs. It is also disadvantageous that the formation of the welded joint of plastic bristles and bristle carrier requires considerable precision and care and in the case of some material pairs cannot be achieved or can only be achieved with considerable expenditure.

SUMMARY OF THE INVENTION

The aim underlying the present invention resides in avoiding the above disadvantages encountered in the prior art. According to the invention, a bolt is shaped as an attachment and a contour used for fixing to the bristle carrier is simultaneously or subsequently shaped on to the bolt and with a corresponding contour being provided on or in conjunction with the bristle carrier.

According to the invention, the melted on material of the plastic bristles is formed into a bolt, which then comprises solid plastic and simultaneously serves to produce a fastening aid for a detachable fastening to the bristle carrier. For this purpose, in connection with the shaping or subsequent thereto, on the bolt is shaped a contour which forms part of a detachable fastening, the counterpart being shaped on to the bristle carrier or provided as a separate part, by means of which the bristle bundle can then be detachably fixed to the bristle carrier. The material required for shaping the bolt is made available by advancing the bristle bundle corresponding to the melt advance.

The invention makes it possible to use the same or different plastics for the bristles and bristle carrier, the fastening of the bristles to the bristle carrier always being of the same good quality. In particular it is possible to equip with the bristle bundles according to the invention bristle carriers made from non-weldable plastics and other materials, such as wood, metal or the like. The bristle carrier can have random geometrical shapes, e.g. can be constructed as a roller with an inner or outer covering, as a plate or body with a random contour, as a flexible band, strip or the like.

Preferably, the contour is chosen in such a way that a detachable fastening is obtained, then the possibility is provided of replacing all or part of the bristle bundle, e.g. when corresponding wear occurs. This advantage is particularly marked in the case of large brushes, such as those used on mechanical washing plants, street cleaning machines, polishing brushes, etc., because in this case the support structure for the bristle bundles is generally more expensive than the bristles and there is frequently a non-uniform wear.

According to the invention, an external thread is shaped on to the bolt and a threaded hole is provided on the bristle carrier. In addition, apart from the external thread, a polygonal contour can be shaped on the bolt. This construction makes it possible to threadably insert the bristle bundles individually into the bristle carrier.

It is also possible for the bristle carrier to have a through-hole, through which the bolt provided with the external thread is passed and fixed with a nut. Here again different material pairs are possible for the bolt and nut, as well as for the bristle carrier. By virtue of such an arrangement, it is possible to provide for thin-walled, flexible bristle carriers, such as, for example, for all-round bristle bands.

In accordance with further features of the present invention, the bolt is shaped as an expanding mandrel and a corresponding receptacle is provided on the bristle carrier. In this construction, the individual bristle bundles can be directly inserted into the receptacle and, after insertion of the attachment, the attachment is expanded and the bristle bundle fixed to the bristle carrier. By virtue of these features and the aforementioned features, the cross-section of the bristle bundles can differ from that of the attachment so that, for example, a rectangular bundle can be combined with a cylindrical bolt or vice versa. In the case of a rectangular bristle bundle, the advantage is obtained that larger surfaces can be more densely covered.

Advantageously in accordance with the present invention, a collar is provided on the bolt, with the collar engaging the bristle carrier, so that the bristle bundle can be accurately positioned and fixed on the bristle carrier.

In accordance with the still further features of the present invention, a container fastening used as a bristle carrier is shaped on to the bolt in a manner similar to containers for cosmetics, such as nail varnish and the like, as well as medicinals. According to the inventive process, the fastening and brush form a single one-part component. The fastening in the form of an over-clasp or as a submerged clasp can be shaped with the cover disc resting on the container. In the first case the bolt is substantially hollow or a corresponding hollow part is shaped on and with an internal thread forms the screw cap. Instead of this, such a hollow bolt can also have an internal polygon in the manner of a threaded member with a hexagonal recessed hole for the engagement of a corresponding tool, so that the bristle bundle can be fixed from the front or rear to the bristle carrier.

In addition, coating brushes or paintbrushes are known, which simultaneously form the fastening of a container containing the coating medium. A coating medium is directly transferred from the container to the bristles. According to the invention, in the case of such a construction, a channel is shaped in the bolt for guiding the coating medium and discharging the coating medium between the bristles. The channel can optionally be shaped in such a way that an original fastening in the form of a diaphragm or the like remains.

The process according to the invention also offers the possibility of forming a bristle bundle for the bolt having bristles of different cross-sections and/or different materials at their ends. Practical tests have shown that it is even possible to arrange within the bristle bundle natural bristles and to anchor same in the bolt during the shaping thereof. It has been found that up to 50% of the natural bristles can be secured, without any deterioration to the extraction resistance. In addition, it is possible to process in the manner according to the invention so-called filled bristles, i.e. bristles containing grinding or polishing particles and the like.

As a result of the detachable fixing of the bristle bundle to the bristle carrier, in the case of a contoured bristle covering, it is possible according to the present invention to use flat bristle carriers and to fix bristle bundles of different lengths thereto, with the length of the individual bristle bundles being selected in such a way that ends thereof form a desired spacial envelope surface, thereby enabling the obtaining of profile brushes.

In order to simplify the manufacture of the bristle bundles, according to a further feature of the invention, the free ends thereof can be melted and shaped to a thin disc joining the same, so that the bristles are held together at their free ends and cannot expand or bend during the manufacturing process. During the production of the brush, the thin disc is then cut off or is eliminated during the further use thereof by making it so thin that it peels or strips off in the case of mechanical stressing.

BRIEF DESCRIPTION OF THE DRAWINGS

The invention is described in greater detail hereinafter relative to non-limitative embodiments and the attached drawings.

DETAILED DESCRIPTION OF THE PREFERRED EMBODIMENTS

Figure 1:
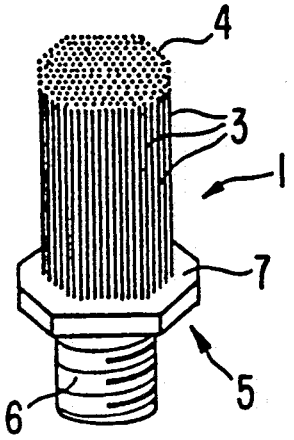
FIG. 1 is a perspective view of a bristle bundle arrangement constructed in accordance with the present invention.

Referring now to the drawings wherein like reference numerals are used throughout the various views to designate like parts and, more particularly, to FIG. 1, according to this figure, a bristle bundle generally designated by the reference numeral 1 is formed from a plurality of individual bristles 3 which are produced in bundles or from a continuous strand. While the bristle bundle 1 is illustrated as having an octagonal contour 4, it is understood that the bristle bundle 1 can have a random contour.

The thermoplastic material bristles are melted in the vicinity of one end thereof and a bolt generally designated by the reference numeral 5 is shaped from the resulting melt with the melting and shaping taking place in one or more separate operations. In the same or a separate operation, on the bolt 5 are shaped fixing aids for the bristle bundle 4 to a bristle carrier. In the embodiment according to FIG. 1, the bolt 5 is shaped to form a threaded pin 6, which can be screwed into a corresponding threaded hole on a bristle carrier (not shown). To this end, the bolt 5 is provided with a polygonal surface polygon 7, e.g. a hexagon, for enabling a fastening of the bristle bundle 1 by a tool (not shown). The polygonal surface 7 serves to support and secure bolt 5 or bristle bundle 1 on the bristle carrier.

Figure 2:
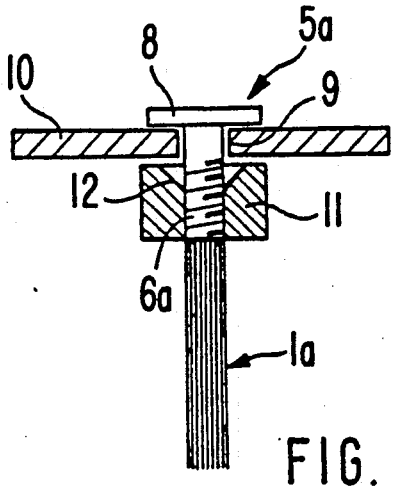
FIG. 2 is a cross-sectional view of another embodiment of a bristle bundle constructed in accordance with the present invention.

As shown in FIG. 2, a bolt **5*a* is shaped as a threaded pin 6*a* at the end of the bristle bundle 1*a*, with the external thread being directly attached to the bristle bundle 1*a*. The threaded pin 6*a*, not provided with a thread over an entire length thereof, is provided at its end with a supporting disc 8. As a result, the bristle bundle 1*a* with the shaped bolt 5*a* can be introduced from the back of a bristle carrier 10 through a through-hole 9 and can be fixed to the bristle carrier 10 by a nut 11 threaded at the front over the bundle 1*a*. To facilitate the threading operation, the nut 11 is provided on one end face with a conical extension 12**.

Figure 3:
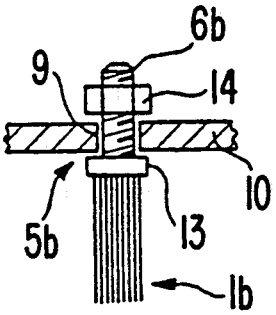
FIG. 3 is a cross-sectional view of a further embodiment of a bristle bundle constructed in accordance with the present invention.

In FIG. 3, a bolt **5*b* of a bristle bundle 1*b* has a supporting disc 13 and a threaded pin 6*b*. The threaded pin 6*b* is introduced from the front through a through-hole 9 of bristle carrier 10 and is fixed to the latter by a nut 14 threaded on to the end of threaded pin 6*b***.

The embodiments of FIGS. 2 and 3 can be used in the case of a random construction of bristle carrier 10, but in particular they permit the use of band-like bristle carriers such as, for example, endless bristle bands, which could not be previously manufactured without very considerable expense. The special advantage of the detachable fastening is again apparent here, in that individual worn bundles **1*a*, 1*b*** can easily be replaced in the case of such a bristle band.

Figure 4:
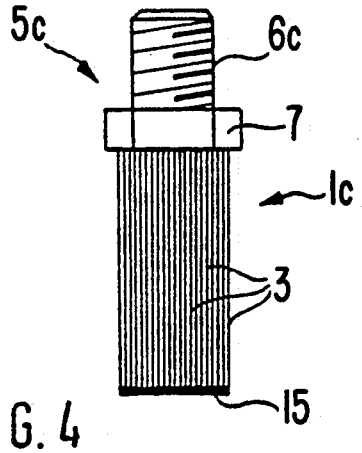
FIG. 4 is a plane view of another embodiment of a bristle bundle connection constructed in accordance with the present invention.

The embodiment of FIG. 4 substantially corresponds to that of FIG. 2, in that the bolt **5*c* is shaped on to a bristle bundle 1*c* and includes a threaded pin 6*c* with a polygonal profile 7. In FIG. 4, the bristles 3 are slightly melted at their free end, so that a thin disc 15** is obtained, by means of which the bristles 3 are held together within the bundle 1c, so that they can be more easily sorted, singled out, moved, handled and processed. The thin disc 15 is cut off during the production of the brush or is automatically separated in the case of mechanical stressing.

Figure 5:
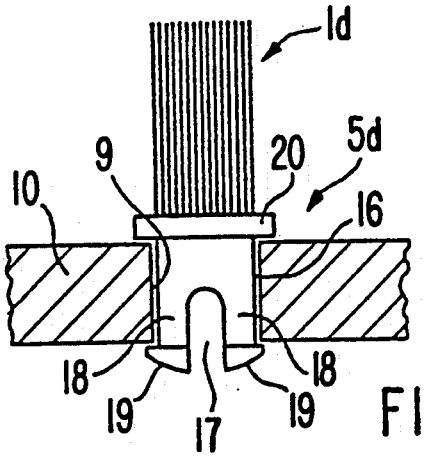
FIG. 5 is a cross-sectional view of a bristle bundle with a shaped attachment and an expanding mandrel constructed in accordance with the present invention.

In FIG. 5, a bolt 5d is shaped in the form of an expanding mandrel 16, in that a slot 17 is shaped into the pin-like attachment, so that the webs 18 which have been left behind can move inwards. The spreading mandrel 16 is also provided at its free end with shaped noses 19. Here again, a supporting disc 20 is provided. The mandrel 16 is inserted from the covered side of bristle carrier 10 into a through-hole 9, the webs 18 moving inwards. In the mounted state, the webs 18 on the back of the bristle carrier 10 again spring up, so that the bristle bundle 1d is anchored in the bristle carrier 10 by the expanding mandrel 16. Bristle bundle 1d can have a rectangular cross-section, so that a surface-covering of a bristle carrier is possible.

Figure 6:
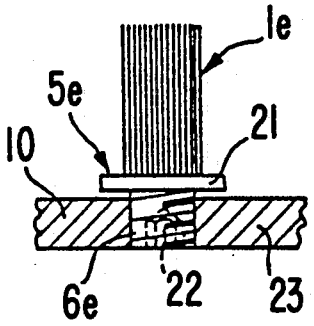
FIG. 6 is a cross-sectional view of a bristle bundle constructed in accordance with the present invention with an internal hexagonal shape.

In FIG. 6, a rectangular or circular bristle bundle 1e is shaped at one end to a bolt 5e in the form of a threaded pin 6e and on to which is once again shaped a disc 21. The threaded bolt includes an internal hexagon 22, which terminates flush with a back 23 of the bristle carrier 10.

Figure 7:
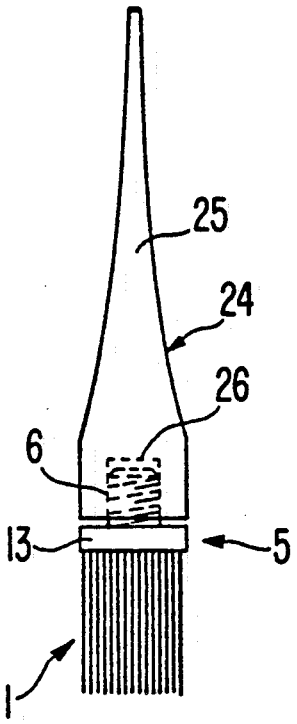
FIGS. 7–9 are plan views of further examples of bristle bundles of the present invention with various shaped threaded attachments.

FIG. 7 shows an example of use of an embodiment as shown in FIG. 1 fashioned as a paintbrush generally designated by reference numeral 24, having a handle 25 provided at an end receiving the bristles with a threaded hole 26, into which the bolt 5 can be threadably inserted with the treaded pin 6 until the supporting disc 13 engages on a face of the handle 25.

Figure 8:
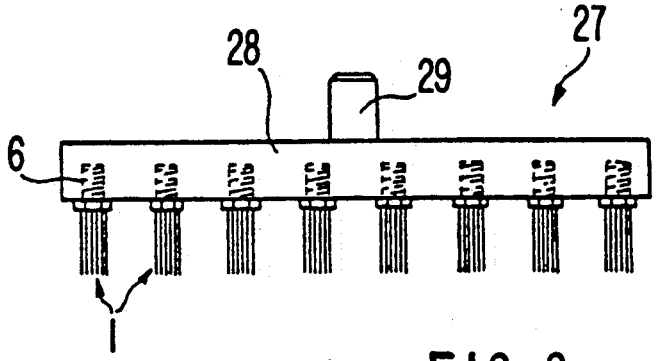

In FIG. 8 a plate or disc brush generally designated by reference numeral 27 includes a disc or plate 28 provided with a fastening pin 29, e.g. for a rotary drive, with a disc 28 being provided with threaded holes on the bristle covering side, into which can be inserted bristle bundles 1c with a threaded attachment, as shown in FIGS. 1 or 4.

Figure 9:
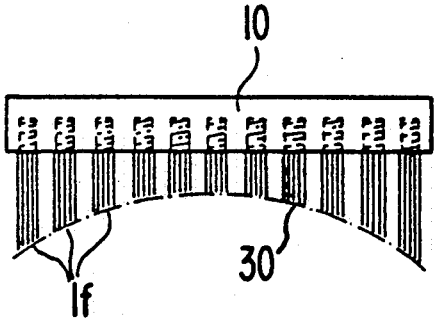

In FIG. 9, a profile brush is provided wherein bundles 1f with threaded attachments are threadable attached to the flat bristle carrier 10, which is once again provided with threaded holes, whereby the bristle bundles 1f can have different lengths, with the free ends of the bristle bundles 1f forming a contoured envelope surface 30.

Figure 10:
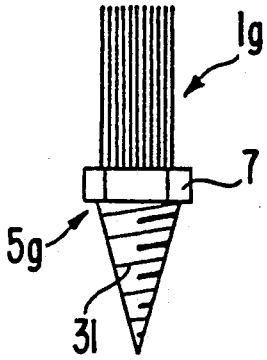
FIGS. 10 and 11 are plan views of alternate embodiments of threaded attachments for bristle bundles constructed in accordance with the present invention.
Figure 11:
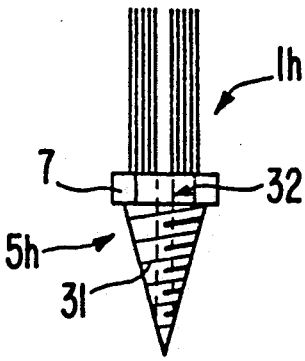

In FIGS. 10 and 11, attachments 5g, 5h shaped on to the respective bristle bundle 1g, 1h once again includes a threaded pin 31, which in each case is conical, so that a self-tapping thread is obtained. In FIG. 10 a polygonal profile 7 for enabling a threadable insertion of the bristle bundle 1g into a carrier is also shaped on attachment 5g. FIG. 11 differs from FIG. 10 in that a channel 32 is also formed in the attachment 5h through which an application or coating medium can be applied to the bristle bundle 1h. The embodiments of FIGS. 10 and 11 make it possible to open an original fastening, such as is used on tubes, tin cans and the like in the form of a sealed-on foil and then to use same as a fastening device. However, instead of this channel 32 can have such an original fastening in the form of a diaphragm left behind during shaping. Such a channel can also be constructed as an internal polygon and can be used for mounting a tool, by means of which the bristle bundle 1h can be fixed to the carrier.

Figure 12:
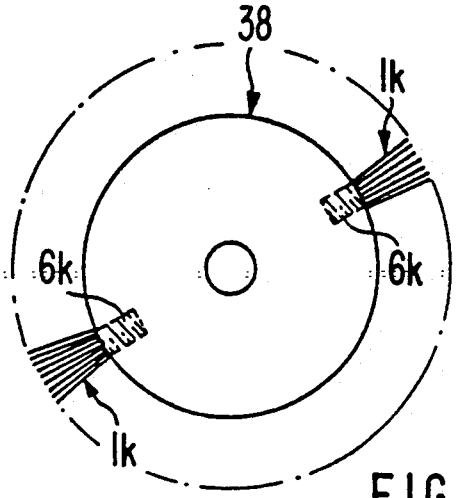
FIG. 12 is a partially schematic view of an application of a bristle bundle of the present invention employed in a roller brush.

FIG. 12 provides an example of a bristle roller 38, such as used for example, in washing plants and the like. The bristle roller 38 has bristle bundles 1k over its entire circumference or part thereof. The bristle bundles 1k are provided with threaded pins 6k or similar fastening means. Here again, individual bristles or rows thereof can be replaced without difficulty. In addition, the material and geometry of the bristle bundles can be adapted to the required function, e.g. in the most stressed regio, it is possible to use bristle bundles made from more wear resistant material and/or positioned closer together.

Figure 13:
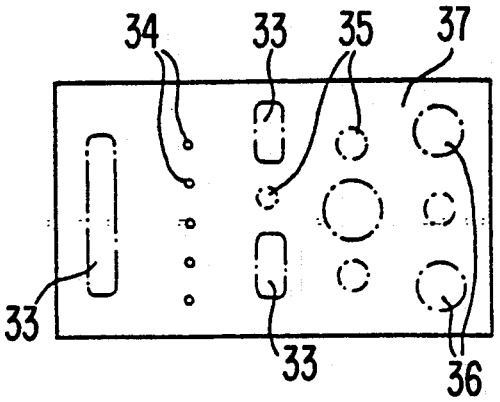
FIG. 13 is a schematic view of an arrangement of bristle bundles according to the present invention for enabling a covering of a large area brush.

FIG. 13 schematically illustrates a possible bristle covering, which could not be manufactured with known technology. On a bristle carrier 37 are simultaneously provided strip-like bristle bundles or groups 33, individual bristles 34 or bristle bundles with a smaller diameter, bundles 35 with a medium diameter and bundles 36 with a large diameter. In correspondingly differing manner, receptacles are provided on bristle carrier 37. The individual bristle bundles can be made from different bristles, so as e.g. to permit different working processes, such as roughening, grinding, polishing, etc. whilst using a single brush.

Figure 14:
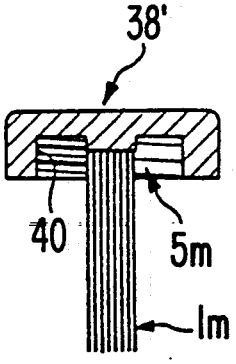
FIG. 14 is a cross-sectional view of yet another embodiment of the present invention.
Figure 15:
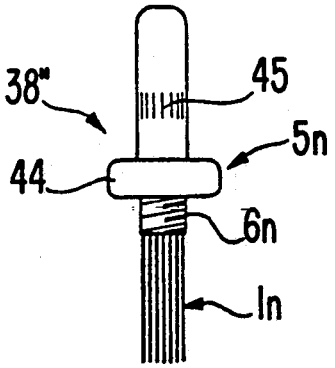
FIG. 15 is a plan view of a further embodiment of the present invention.
Figure 16:
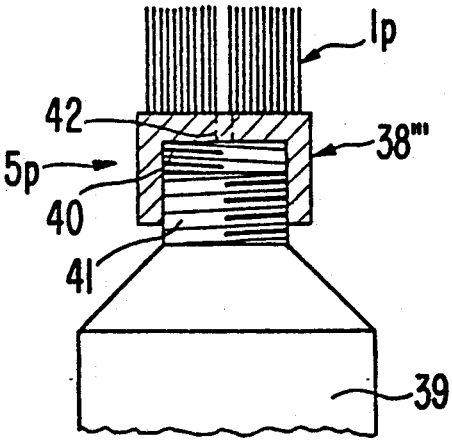
FIG. 16 is a partial cross-sectional view of another embodiment of the present invention.

FIGS. 14 to 16 show embodiments of bristle bundles 1m, 1n, 1p at whose ends is respectively shaped an attachment 5m, 5n 5p in the form of a fastening generally designated by reference numerals 38', 38'', 38''' for a container 39 such as shown in, for example, FIG. 16. In FIG. 14, the fastening 38' is constructed as an overcover with internal thread 40, so that the bristle bundle 1n e.g. passes into the coating medium contained in said container. By means of the internal thread 40, the cover is threadably attached to the external thread of neck 41 of container 39 (FIG. 16). The embodiment of FIG. 16 differs from that of FIG. 14 in that the bristle bundle 1p is positioned externally and is e.g. used as a coating brush. A channel 42 leading the coating medium to the bristle bundle 1p can be shaped in the fastening 38'''.

In FIG. 15, a fastening 38'' formed by bolt 5n is provided with a threaded pin 6n, a cover disc 44 and a gripping part 45. Such a construction is e.g. suitable for the application of cosmetics, pharmaceuticals, etc., whereas the embodiment of FIG. 16 is intended for the application of cleaning agents, shoe cream, etc.

In those embodiments in which the bristle bundle it fixed to the bristle carrier by an additional fastening means such as, for example, FIGS. 2, 3 or 5 naturally two or more bolt-like attachments can be shaped on to a bristle bundle. Means to prevent turning can obviously be provided on the bolt-like attachment, as well as optionally on the bristle carrier.

What is claimed is:

1. A process for the production of brushware comprising a bristle carrier and at least one thermoplastic material bristle bundle fixed thereto, the method comprising the steps of melting ends of the at least one bristle bundle to form a solid attachment means, advancing the at least one bristle bundle in correspondence to a melt advance, shaping the melted ends of the bristle bundle into a bolt having at least a portion which has a greater size than free ends of the at least one bristle bundle, shaping a contour on the bolt for enabling fastening to the bristle carrier, and providing a corresponding contour in the bristle carrier.

2. A process according to claim 1, further comprising shaping an external thread on the bolt, and providing a threaded hole on the bristle carrier.

3. A process according to claim 2, wherein the step of shaping a contour includes forming a polygonal shape to the bolt adjacent the external thread.

4. A process according to claim 1, further comprising providing an external thread on the bolt, and providing a through-hole in the bristle carrier for accommodating the external thread of the bolt, and fastening the bolt to the bristle carrier by a fastening nut.

5. A process according to claim 1, wherein the step of shaping the melted ends into the bolt includes forming the bolt as an expanding mandrel and providing a corresponding receptacle on the bristle carrier.

6. A process according to claim 1, further comprising shaping a collar onto the bolt for engaging on the bristle carrier.

7. A process according to claim 1, further comprising shaping a fastening for a container serving as a bristle carrier onto the bolt.

8. A process according to claim 7, wherein the step of shaping a fastening includes forming a screw cap.

9. A process according to claim 7, wherein the step of shaping a fastening includes forming a submerged fastening with a cover disc for mounting on the container.

10. A process according to claim 1, wherein the step of shaping the melted ends includes forming a hollow bolt provided with an internal thread means.

11. A process according to claim 1 for producing coating brushes further comprising simultaneously forming a fastening of a container containing a coating medium, and forming a channel carrying the coating medium in the bolt so as to enable the coating medium to issue between the bristles.

12. A process according to claim 1, wherein the at least one bristle bundle includes at least one of bristles of different cross-section and different materials at their ends.

13. A process according to claim 1, wherein natural bristles are arranged within the at least one bristle bundle and are anchored in the bolt during the step of melting of the plastic bristles and the shaping of the bolt.

14. A process according to claim 1, wherein a cross-section of the at least one bristle bundle and that of the bolt have a different shape.

15. A process according to claim 1 for producing brushes, in which an envelope surface of the free bristle ends has a spatial contour differing from the plane, wherein a planar bristle carrier is used and a plurality of bristle bundles of different lengths are detachable fixed thereto.

16. A process according to claim 1, wherein the free ends of the at least one bristle bundle are melted on and shaped to a thin disc joining the same.

* * * * *